US006851961B2

(12) United States Patent
Lin

(10) Patent No.: US 6,851,961 B2
(45) Date of Patent: Feb. 8, 2005

(54) POWER ADAPTER

(75) Inventor: Sheng-Chieh Lin, Taoyuan (TW)

(73) Assignee: Delta Electronics, Inc., Taoyuan Shien (TW)

( * ) Notice: Subject to any disclaimer, the term of this patent is extended or adjusted under 35 U.S.C. 154(b) by 0 days.

(21) Appl. No.: 10/099,312

(22) Filed: Mar. 15, 2002

(65) Prior Publication Data

US 2002/0130559 A1 Sep. 19, 2002

(30) Foreign Application Priority Data

Mar. 16, 2001 (TW) ..... 90204020 U

(51) Int. Cl.[7] ..... H01R 29/00
(52) U.S. Cl. ..... 439/221; 439/638
(58) Field of Search ..... 439/131, 171, 439/218, 221, 518, 651, 638

(56) References Cited

U.S. PATENT DOCUMENTS 4,571,717 A * 2/1986 Reichel et al. ..... 439/638
5,459,637 A * 10/1995 Ma et al. ..... 439/638
5,616,051 A * 4/1997 Rogers et al. ..... 439/518
6,227,888 B1 * 5/2001 Hahn ..... 439/173
6,261,109 B1 * 7/2001 Liu et al. ..... 439/131

* cited by examiner

*Primary Examiner*—Renee Luebke
(74) *Attorney, Agent, or Firm*—Alston & Bird LLP

(57) ABSTRACT

The present invention discloses a power adapter for connecting an electric appliance to an AC main power. The power adapter includes an electrical device having at least two metal prongs in the power input/output end thereof, and a connector having at least two recesses for sleeving the metal prongs respectively and electrically connecting the connector to the electrical device. In addition, there is a height difference between the bottoms of the connector and the electrical device. Moreover, each of the two sides of the connector includes a hollow region respectively for the convenience of assembling and disassembling the connector and the electrical device. Furthermore, there are pit-knob matching structures in the connector and the electrical device for fixing the position and preventing unfastening of the connector and the electrical device in the assembling state.

7 Claims, 6 Drawing Sheets

POWER ADAPTER

FIELD OF THE INVENTION

This invention relates to a power adapter, and more particularly to a power adapter for connecting an electric appliance to an AC main power.

BACKGROUND OF THE INVENTION

Currently, electric appliances have been widely used in daily life. Many electric appliances such as portable electric appliances and mobile phones are more and more common in daily life, and these electric appliances have to be power supplied through the AC converting adapters.

Please refer to FIG. 1. FIG. 1 is a schematical view showing the structure of the power adapter according to the prior art including an electrical device (such as a power supply or a charger) 10 and an AC cable 11. The electrical device 10 is connected to a power receptacle by the AC cable 11 to provide the main power for the electrical device 10. However, such way for connecting an electric appliance to an AC main power has the following disadvantages:

1. Inconvenient to carry: It is inconvenient for a user to carry the AC cable when traveling on business or for a vacation. In addition, the plug form of the AC cable is fixed and thereby cannot adapt to different receptacle forms in different countries of the world.

2. Easy to cause danger: People are tripped over the cable easily when using carelessly and therefore the accidents will happen.

Therefore, the present invention provides a portable power adapter for connecting an electric appliance to an AC main power which overcomes the disadvantages described above.

SUMMARY OF THE INVENTION

It is an object of the present invention to provide a power adapter for using safely and carrying conveniently.

It is another object of the present invention to provide a power adapter with a height difference design for holing and forcing easily and increasing the heat-dissipating efficiency of the electrical device and the connector.

It is an additional object of the present invention to provide a power connector with a hollow region design for the convenience of assembling and disassembling the connector and the electrical device.

In accordance with an aspect of the present invention, the power adapter for connecting an electric appliance to an AC main power includes an electrical device having at least two metal prongs in the power input/output end thereof, and a connector having at least two recesses for sleeving the metal prongs respectively and electrically connecting the connector to the electrical device. In addition, there is a height difference between the bottoms of the connector and the electrical device.

Preferably, the electrical device is a power supply or a charger.

Preferably, the metal prongs are disposed in a cavity of the electrical device, and the recesses are disposed on a protruding portion of the connector.

Preferably, the shapes and sizes of the cavity and the protruding portion are the same for matching and fixing tightly.

Preferably, the connector further includes at least two conducting slices for plugging the power adapter in an exterior AC receptacle.

Preferably, the conducting slice is made of copper.

Preferably, when the conducting slices are plugged in the exterior AC receptacle, a space is formed below the bottom of the electrical device by the height difference, which is beneficial for holding and forcing by a user and increases the heat-dissipating efficiency of the electrical device and the connector.

Preferably, each of the two sides of the connector includes a hollow region respectively for the convenience of assembling and disassembling the connector and the electrical device.

Preferably, the connector further includes at least one pit (or knob) and the electrical device further includes at least one knob (or pit) for fixing the position and preventing unfastening of the connector and the electrical device.

In accordance with another aspect of the present invention, the power adapter for converting an alternating current (AC) includes an electrical device having at least two metal prongs in the power input/output end thereof; and a connector having at least two recesses for sleeving the metal prongs respectively and electrically connecting the connector to the electrical device. In addition, each of the two sides of the connector includes a hollow region respectively for the convenience of assembling and disassembling the connector and the electrical device.

Preferably, the electrical device is a power supply or a charger.

Preferably, the metal prongs are disposed in a cavity of the electrical device, and the recesses are disposed on a protruding portion of the connector.

Preferably, the shapes and sizes of the cavity and the protruding portion are the same for matching and fixing tightly.

Preferably, the connector further includes at least two conducting slices for plugging the power adapter in an exterior AC receptacle.

Preferably, the conducting slice is made of copper.

Preferably, when the conducting slices are plugged in the exterior AC receptacle, a space is formed below the bottom of the electrical device by a height difference between the bottoms of the connector and the electrical device, which is beneficial for holding and forcing by a user and increases the heat-dissipating efficiency of the electrical device and the connector.

Preferably, the connector further includes at least one pit (or knob) and the electrical device further includes at least one knob (or pit) for fixing the position and preventing unfastening of the connector and the electrical device.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
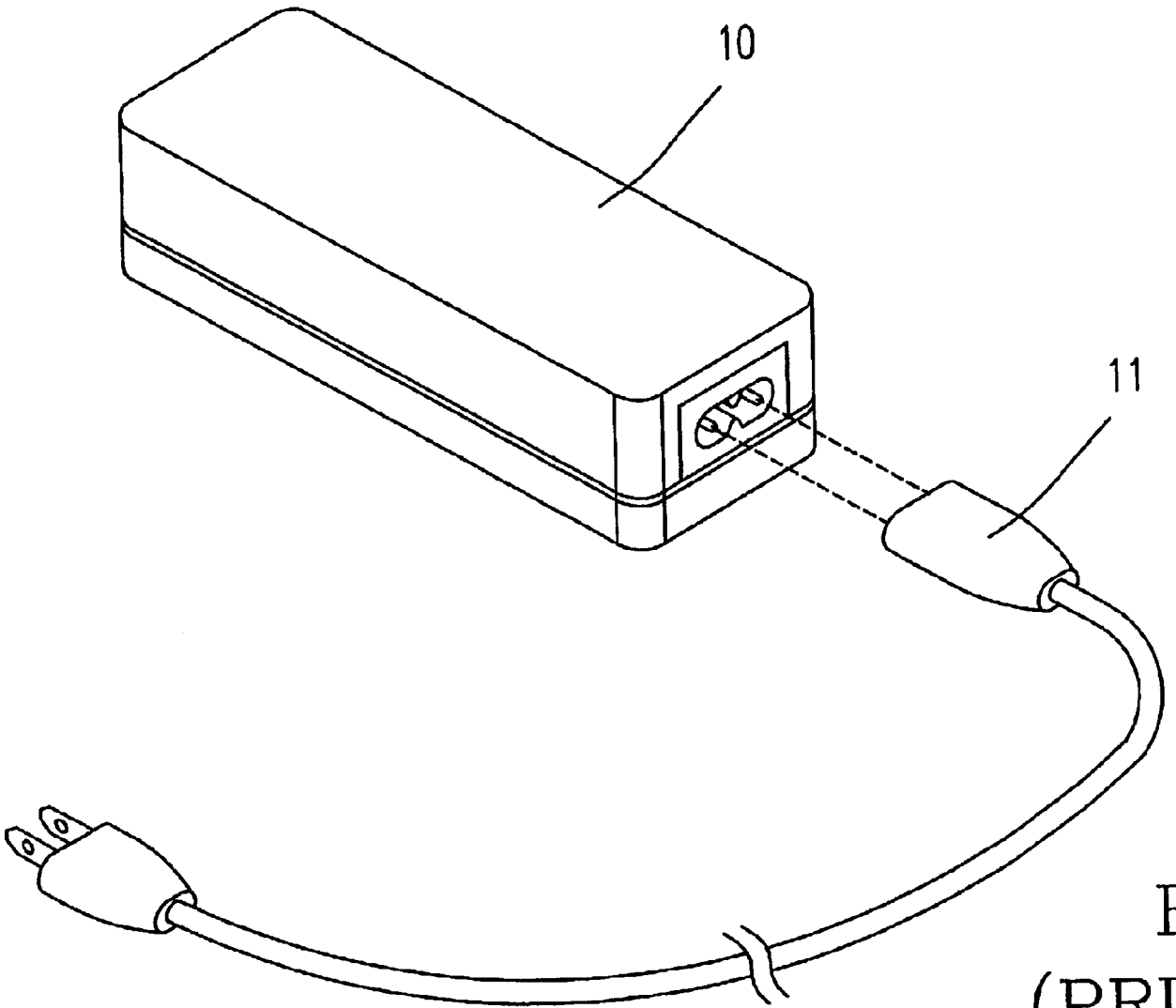
Fig. 1 (PRIOR ART)
FIG. 1 is a schematical view showing the structure of the power adapter according to the prior art.
Figure 2:
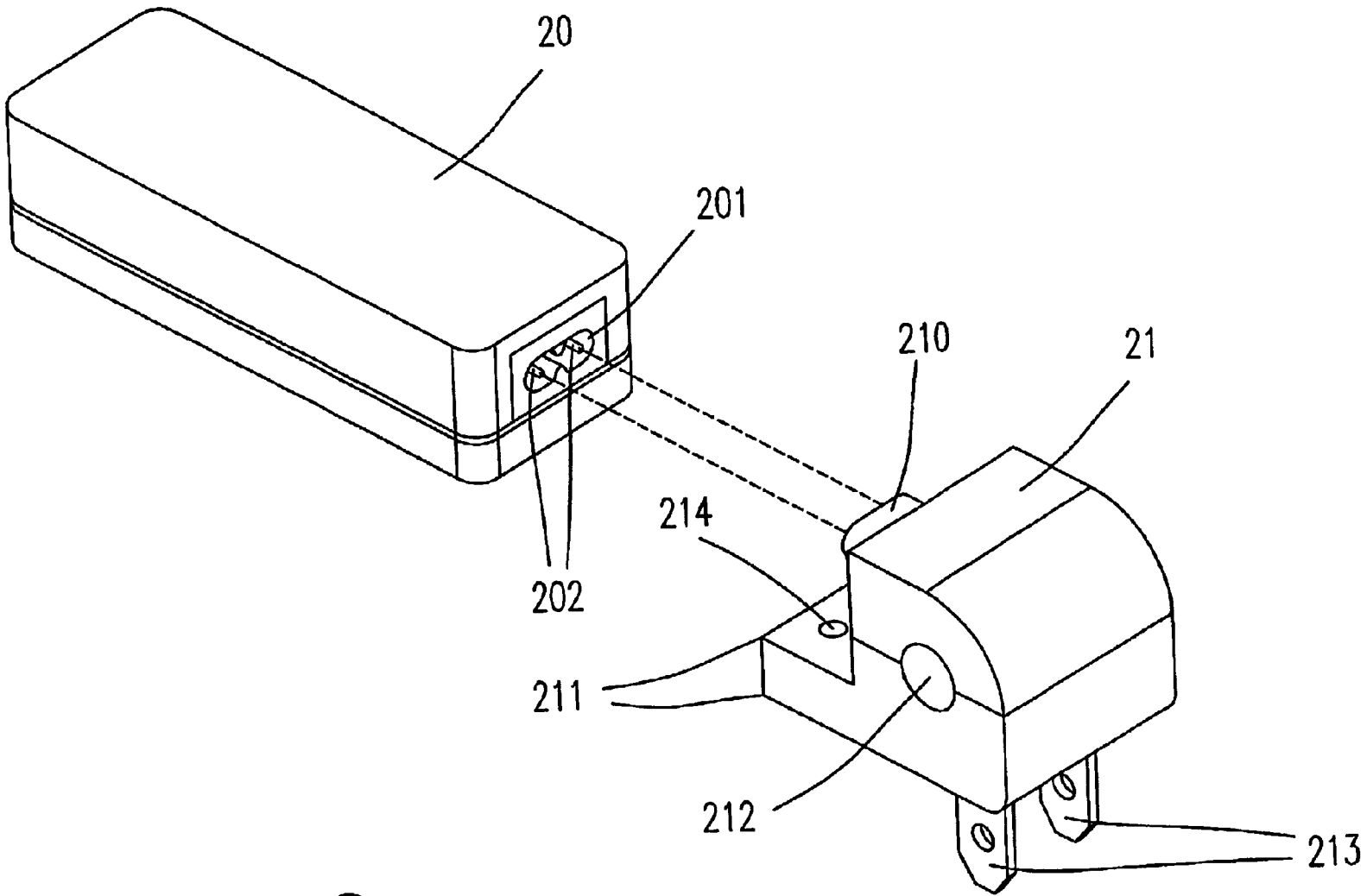
FIG. 2 is a schematical view showing the disassembling structure of the power adapter according to a preferred embodiment of the present invention.
Figure 3:
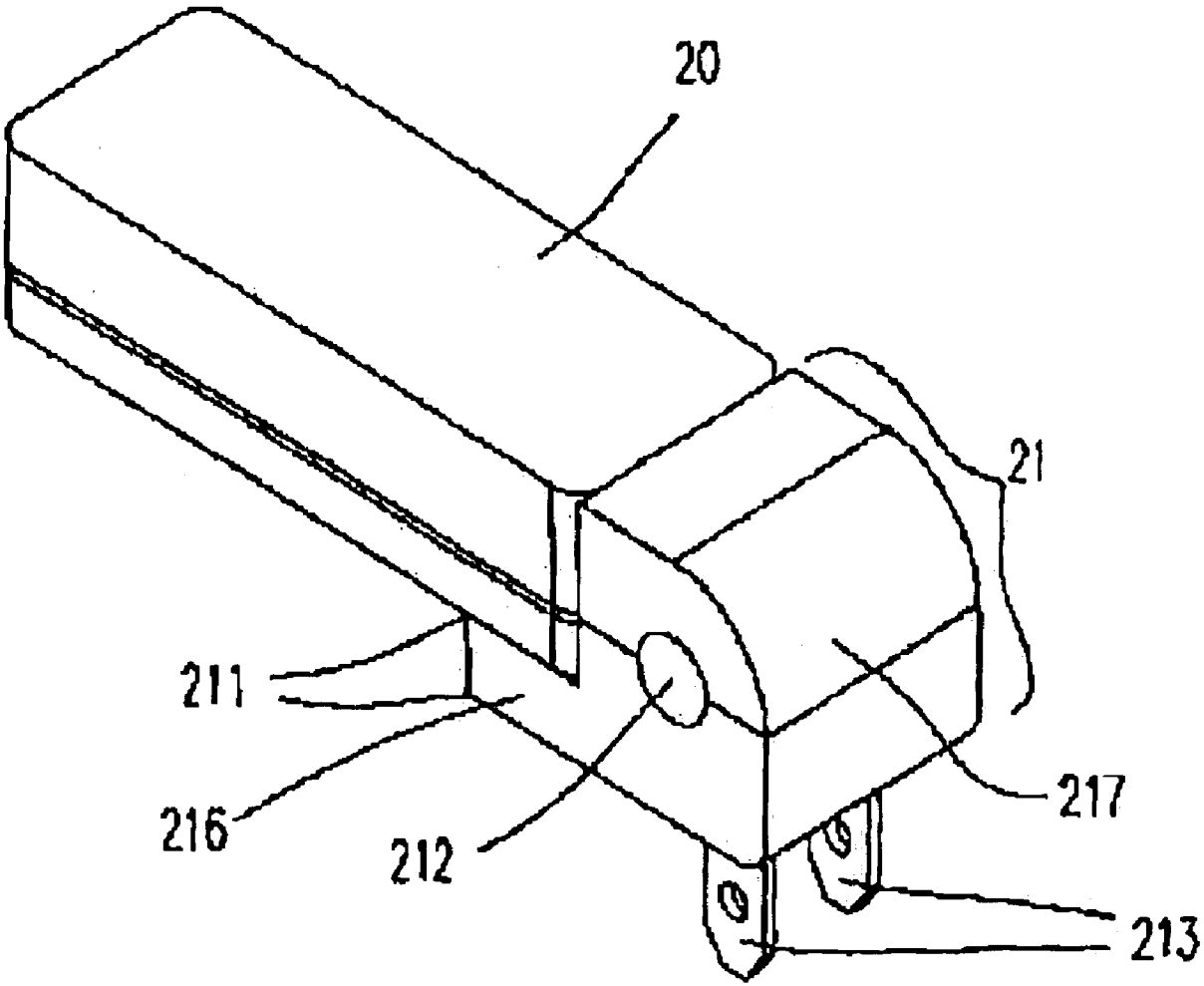
FIG. 3 is a schematical view showing the assembling structure of the power adapter according to a preferred embodiment of the present invention.
Figure 4:
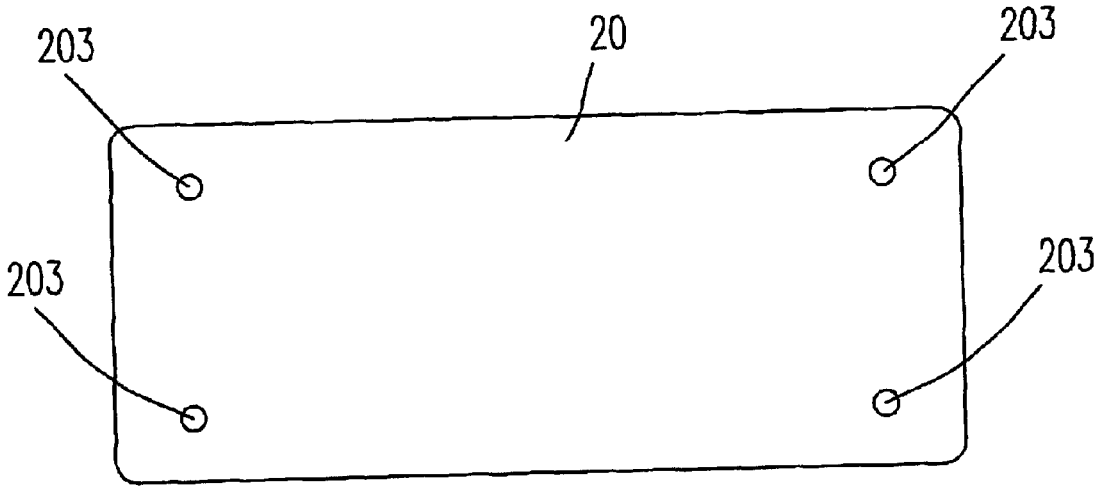
FIG. 4 is a bottom plane view showing the structure of the electrical device according to a preferred embodiment of the present invention.
Figure 5:
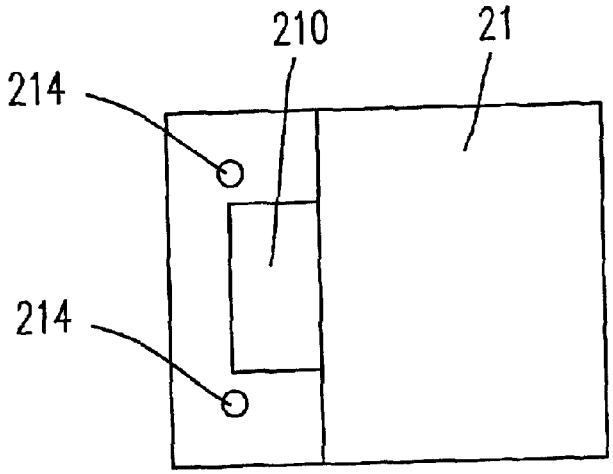
FIG. 5 is a top plane view showing the structure of the connector according to a preferred embodiment of the present invention.

Please refer to FIGS. 2 and 3 showing the structure of the power adapter according to a preferred embodiment of the present invention. A power adapter includes an electrical device 20 and a connector 21 for connecting an electric appliance to an AC main power. The electrical device 20 is a power supply or a charger. The power input/output end of the electrical device 20 has two metal prongs 202 disposed in a cavity 201. Preferably, the two metal prongs are two metal sticks, and the number of the metal prongs are variable to meet the requirements or the standards in different countries.

Please refer to FIG. 2 and FIG. 3. The connector 21 has a body 217 and two recesses (not shown) disposed on a protruding portion 210. The two recesses can sleeve the two metal prongs 202, such that the connector 21 and the electrical device 20 can be tightly assembled and electrically connected (as shown in FIG. 3) so as to connect the electric appliance to the AC main power. The cavity 201 having two metal prongs 202 therein matches with the protruding portion 210 of the connector 21 for tightly assembeling the electrical device 20 and the connector 21. In addition, a height difference 211 is formed between the bottoms of the connector 21 and the electrical device 20. When the two conducting slices 213 of the power adapter are plugged in an exterior AC receptacle (not shown), a space is formed below the bottom of the electrical device 20 via the height difference, which is beneficial for holding and forcing be a user and increases the heat-dissipating efficiency of the conducting slices 213 of the connector 21 and the electrical device 20. Furthermore, each of the two sides of the body 217 of the connector 21 includes a hollow region 212 respectively for the convenience of assembling and disassembling the connector 21 and the electrical device 20.

Preferably, the conducting slices 213 of the connector 21 are made of copper, and the shapes and the number of the conducting slices 213 can be variable to meet different receptacle standards of different countries. In addition, the conducting slices can be designed as a rotatable form which can be folded down for the convenience of carry and storage.

Figure 6:
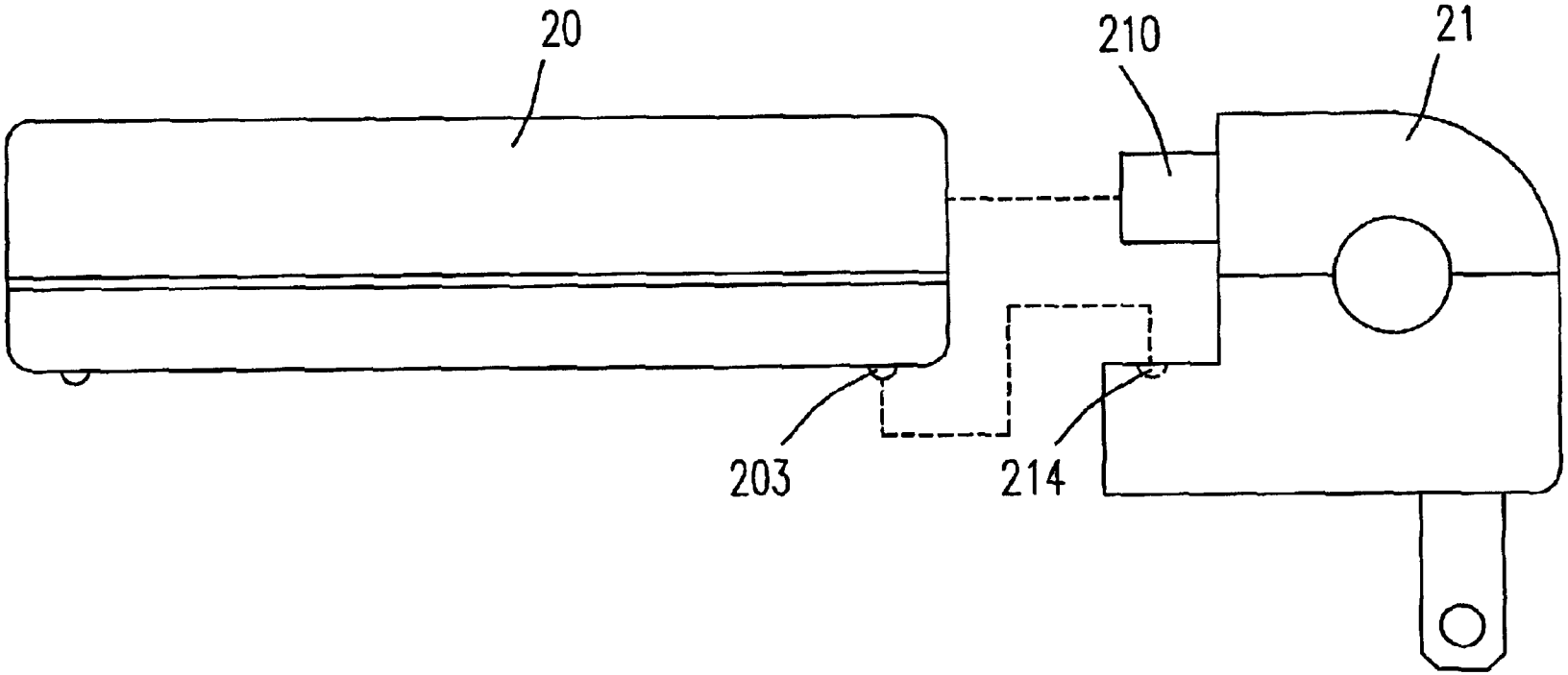
FIGS. 6 and 7 are schematical views showing the pit-knob matching structures of the power adapter according to a preferred embodiment of the present invention.
Figure 7:
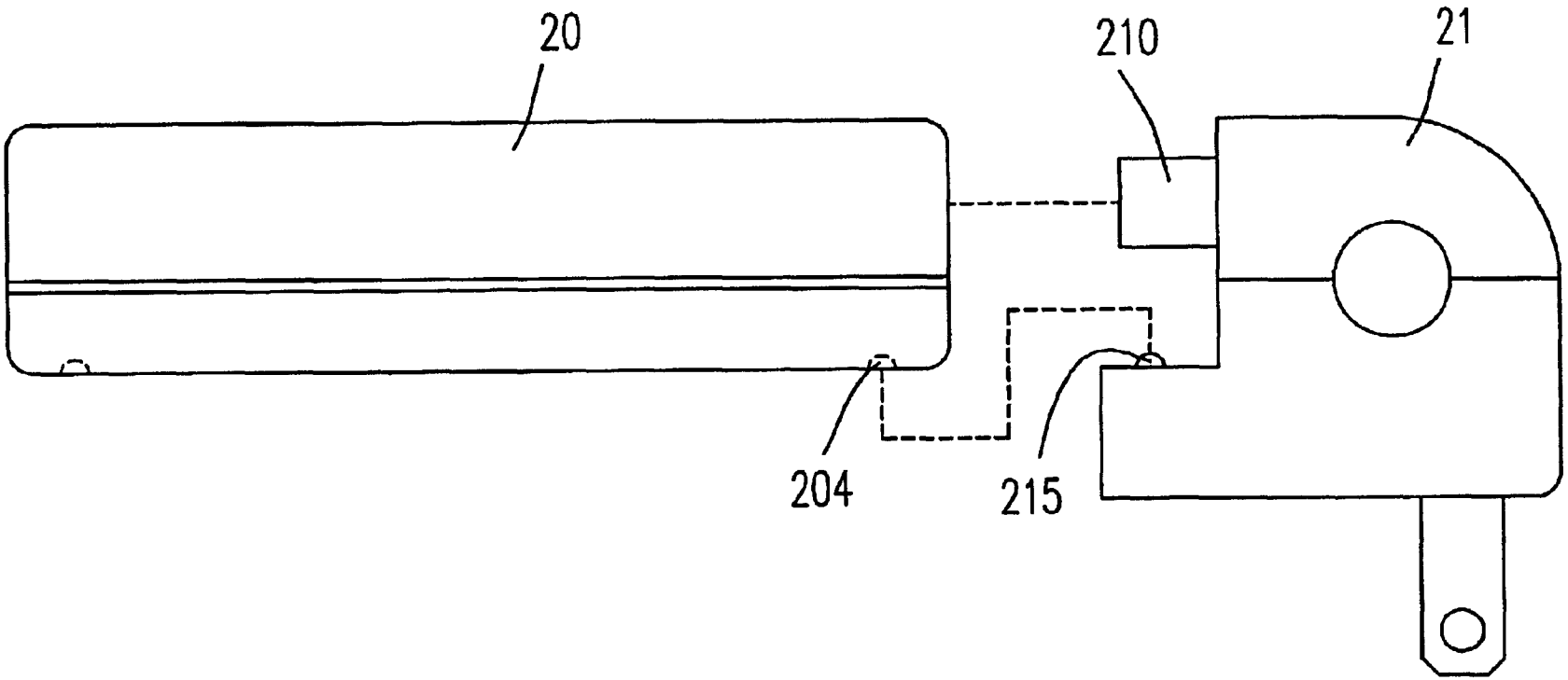

Please refer to FIGS. 4 to 7. Generally, there are four knobs 203 respectively at the four corners of the bottom of the electrical device 20. Accordingly, the connector 21 of the present invention further includes two pits 214 which can match with the two knobs 203 in the connecting end of the electrical device 20 positioning and preventing the connector 21 and the electrical device 20 from unfastening (as shown in FIG. 6) when they are used. Furthermore, the connector 21 has a signal layer 216 positioned under the bottom of the electrical device 20 (as shown in FIG. 3) when the knobs 203 are held by the pits 214. Of course, such function can be also achieved by matching two pits 204 of the electrical device 20 and two knobs 215 of the connector 21 (as shown in FIG. 7).

In conclusion, the power adapter according to the present invention has the following advantages:

1. The cavity matches with the protruding portion, so that the electrical device and the connector can be tightly assembled and electrically connected. Thus, the power adapter design of the present invention is simple and practicable.

2. Due to the height difference between the bottoms of the connector and the electrical device, there is a space below the bottom of the electrical device which is beneficial for holding and forcing by a user and increases the heat-dissipating efficiency of the electrical device and the connector.

3. The connector has two hollow regions on both sides respectively, and is therefore convenient for a user to assemble and disassemble the connector and the electrical device.

4. There are pit-knob matching structures in the connector and the electrical device for positioning and preventing detachment of the connector and the electrical device when they are assembled.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A power adapter for connecting an electric appliance to an AC main power, comprising:

an electrical device having a power input/output end and an adjacent bottom, at least two metal prongs in the power input/output end and a plurality of knobs protruding from said bottom; and a connector comprising a body having a bottom and at least two recesses for sleeving said metal prongs respectively and electrically connecting said connector to said electrical device; a signal layer extending from said body and having a surface oriented so as be positioned under the bottom of the electrical device, and a plurality of pits sinking in said surface of said signal layer and positioned for receiving and holding said knobs, wherein there is a height difference between the bottom of said connector and said bottom of said electrical device, each of two surfaces of said body has a hollow region thereon for the convenience of assembling and disassembling said connector and said electrical device, and said knobs and said pits are used for fixing the position and preventing unfastening of said connector and said electrical device.

2. The power adapter according to claim 1 wherein said electrical device is one of a power supply and a charger.

3. The power adapter according to claim 1 wherein said metal prongs are disposed in a cavity of said electrical device, and said recesses are disposed on a protruding portion of said connector.

4. The power adapter according to claim 3 wherein the shapes and sizes of said cavity and said protruding portion are the same for matching and fixing tightly.

5. The power adapter according to claim 1 wherein said connector further comprises at least two conducting slices for plugging said power adapter in an exterior AC receptacle.

6. The power adapter according to claim 5 wherein said at least two conducting slices are made of copper.

7. The power adapter according to claim 5 wherein when said conducting slices are plugged in said exterior AC receptacle, a space is formed below the bottom of said electrical device by said height difference, which is beneficial for holding and forcing by a user and increases the heat-dissipating efficiency of said electrical device and said connector.

* * * * *

UNITED STATES PATENT AND TRADEMARK OFFICE

CERTIFICATE OF CORRECTION

PATENT NO. : 6,851,961 B2
DATED : February 8, 2005
INVENTOR(S) : Lin

It is certified that error appears in the above-identified patent and that said Letters Patent is hereby corrected as shown below:

Column 1,
Lines 28-30, cancel "2. Easy to cause danger: People are tripped over the cable easily when using carelessly and therefore the accidents will happen." and insert -- 2. danger-Dangerous: People are tripped by the cable easily when used carelessly which results in accidents. --.

Column 3,
Line 52, "signal layer 216" should read -- single layer 216 --.

Signed and Sealed this

Tenth Day of May, 2005

JON W. DUDAS
*Director of the United States Patent and Trademark Office*